United States Patent [19]

Watson et al.

[11] Patent Number: 4,474,565

[45] Date of Patent: Oct. 2, 1984

[54] BLANK STRIPPING APPARATUS FOR ROTARY DIE CUTTERS

[75] Inventors: Raymond S. Watson, Baltimore; William F. Ward, Sr., Hampstead, both of Md.

[73] Assignee: The Ward Machinery Company, Cockeysville, Md.

[21] Appl. No.: 352,199

[22] Filed: Feb. 25, 1982

[51] Int. Cl.[3] ..... B26D 7/18

[52] U.S. Cl. ..... 493/342; 83/116; 83/137; 493/82

[58] Field of Search ..... 493/82, 83, 342, 373; 83/116, 115, 137

[56] References Cited

U.S. PATENT DOCUMENTS

| | | | |
|---|---|---|---|
| 1,784,487 | 12/1930 | Feeney | 83/116 |
| 3,186,274 | 6/1965 | Winkler et al. | 493/342 X |
| 3,410,183 | 11/1968 | Sarka | 493/373 X |
| 3,606,824 | 5/1969 | Remington | 493/342 X |
| 3,956,974 | 5/1976 | Schröter | 493/342 |

*Primary Examiner*—James F. Coan

*Attorney, Agent, or Firm*—John F. McClellan, Sr.

[57] ABSTRACT

Improved blank-stripping apparatus for rotary die cutters of the type which have a die cutting roll, and an anvil roll for supporting paperboard blanks against a cutting rule on the die cutting roll, includes a rotary-cam-timed valve system pressure-actuating one or more pneumatic piston and cylinder assemblies within or adjacent the cutting rule for ejecting scrap radially from the cutting rule in synchronism with rotation of the die cutting roll; after scrap ejection the valve system vents pressure so that contact with a succeeding paperboard blank and/or spring bias easily retracts the plunger to position for pneumatic actuation in the succeeding cycle of operation.

10 Claims, 3 Drawing Figures

BLANK STRIPPING APPARATUS FOR ROTARY DIE CUTTERS

BRIEF SUMMARY OF THE INVENTION

Apparatus for stripping scrap portions of a paperboard (corrugated board) blank from the die cutting rules used to cut the scrap portions in the blank, comprising a pair of rolls between which the blank is advanced for cutting the scrap portions therein, one of the rolls having the die cutting rules mounted thereon and the other roll comprising a resilient roll penetratable by the die cutting rules. A scrap ejector which may be mounted within the cutting rules, is pneumatically actuated following cutting of the scrap portions in the blank to push the scrap portions from the cutting rules.

The present invention is of the type wherein the paperboard blanks are die cut in such manner as to leave scrap portions in the cutting rules for subsequent removal or stripping. Such blanks are passed between a pair of rolls, one of which includes die cutting rules and the other of which supports the blanks against the pressure of the die cutting rules. As the rolls rotate, scrap portions are cut in the blanks by the cutting rules, such rules usually forming a regular or irregular cutout in the blank. As the rolls rotate, the cutting rules come out of engagement with the blanks whereupon the scrap ejector is actuated to push the scrap portions out of the rules preparatory to their cutting scrap portions in a succeeding blank. The scrap ejector is preferably in the form of a piston within a housing, such piston including a plunger for pushing the scrap portions out of the cutting rules upon movement of the piston. Pressurized air is directed to one side of the piston at the time that it is desired to eject the scrap.

The arrangement is such that the pistons are actuated after the cutting rules leave the point of tangency with the advancing blank. Air lines extend from the cutting rules to an air valve mounted adjacent one end of the die cutting roll. A cam is mounted on the end of the roll for engagement with the valve once for each rotation of the roll. When the cam actuates the valve, pressurized air flows through the air lines to the piston, causing the piston to move thereby moving the plunger against the scrap portions to push them out of the cutting rules. As the cam comes out of contact with the air valve, the plungers are freed to retract upon engagement with the scrap portion in a succeeding blank, or they may be spring-retracted.

Because paperboard is substantially stiffer than sheet paper and tends to wedge in cutting rules in various directions, depending on die shape, it requires greater force, applied at selected locations, for ejection of scrap. Air blast alone would be unreliable as pressure-escape at the first edge released from the cutting rule would leave the scrap still partially wedged in the cutting rule.

PRIOR ART

U.S. Pat. No. 3,606,824 granted to L. F. Remington on Sept. 21, 1971 for "PRESS AND CONVEYOR WITH SELF-STRIPPING DIE" discloses apparatus to eject scrap from the cutting rule of a platen press in synchronism with retraction of the platen press. FIG. 3A shows two ejector mechanisms, each with a piston protruding from a cylinder with sealing means between, an enlargement on the protruding end of the piston for pushing scrap, and fluid supply means. Either type could be used in the present invention with suitable valving.

Alternatively, if desired, a flexible bladder may be used in lieu of a piston and cylinder arrangement. The bladder may be constrained to expand in one direction upon application of pressurized air. Likewise, a closed metal or plastic bellows may be used. The bellows may be normally collapsed and expand upon application of pressurized air.

BRIEF DESCRIPTION OF THE DRAWINGS

In the drawings, like reference characters refer to like parts.

DETAILED DESCRIPTION

Figure 1:
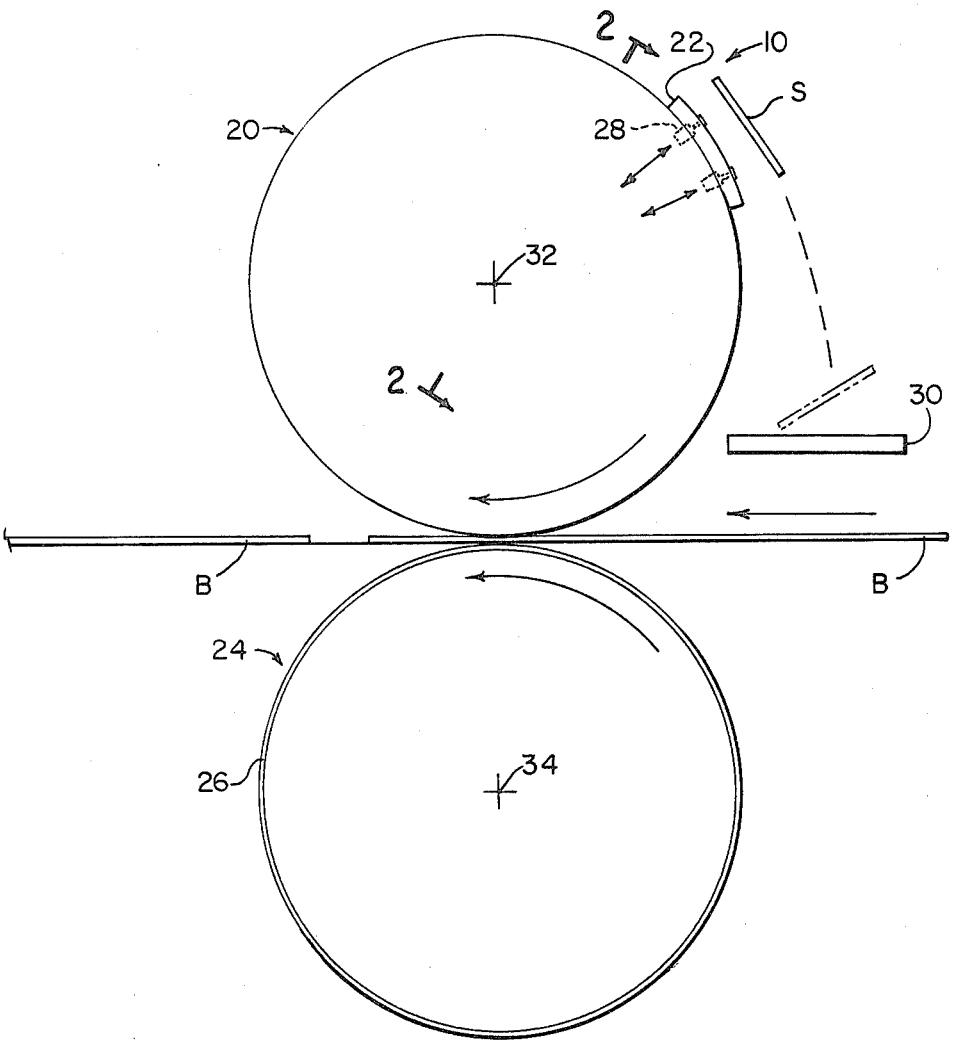
FIG. 1 is an elevational-view schematic diagram of a system embodying the invention.

FIG. 1 diagrams overall relations and operation of the system in an embodiment 10.

Each paperboard blank B advances between a first roll means 20 or die cutter roll with one or more die cutting rules 22 protruding from the circumference and a second roll means 24 or anvil roll with resilient circumference 26 for supporting the paperboard blank against the pressure of the die cutting rule 22. One or more ejectors 28, which may be mounted within the die cutting rules 22, when pneumatically actuated by means to be described radially push the blank scrap S free of the die cutting rules 22 and into any suitable conveyor 30 which is disposed for removal of the blank scrap.

The first and second roll means 20, 24 have parallel axes 32, 34 and rotate substantially in synchronism (arcuate arrows).

Figure 2:
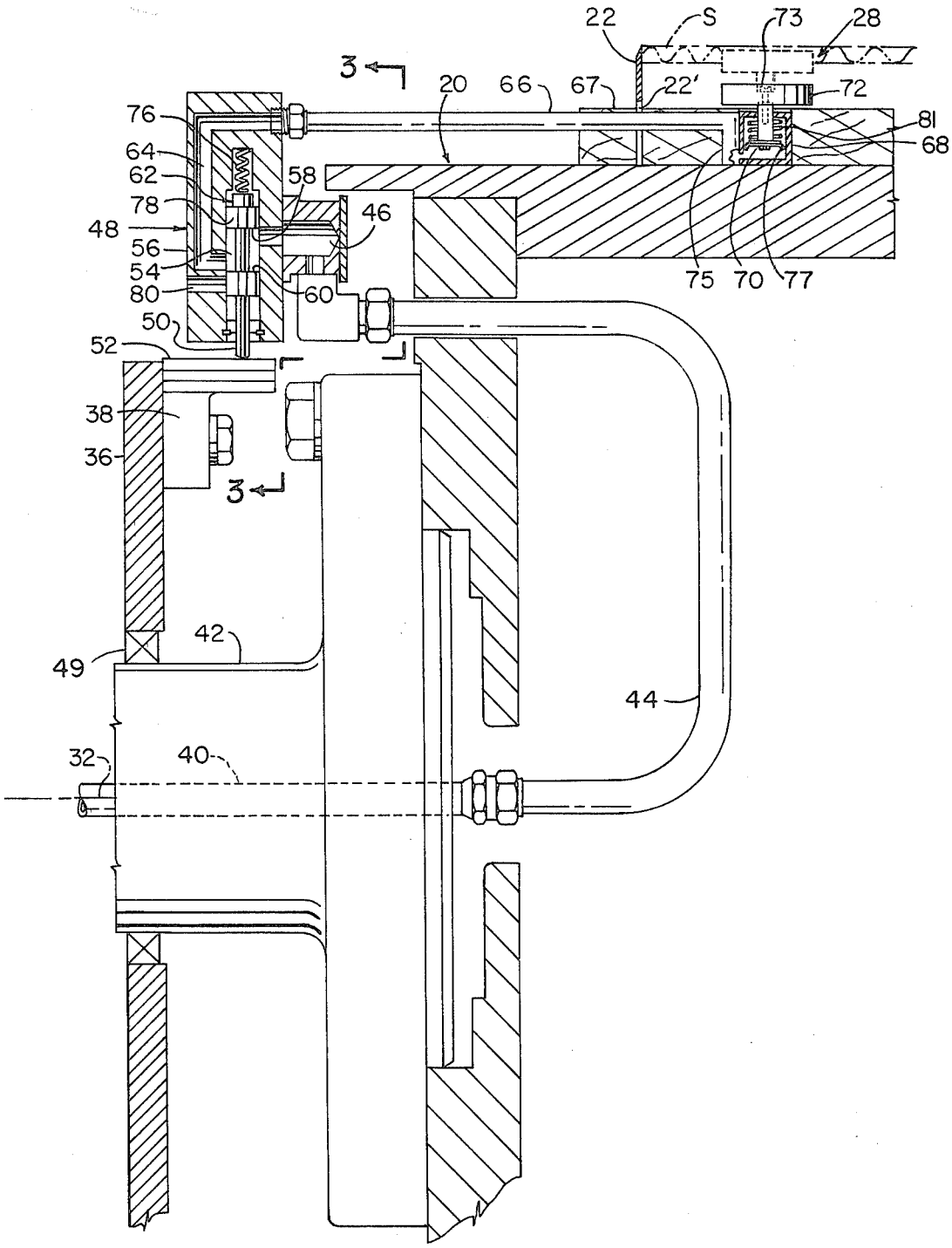
FIG. 2 is a fragmentary detail adapted from 2—2, FIG. 1.

FIG. 2 diagrams scrap ejector 28 installation and actuation details which include associated fixed elements and rotating elements of the system. Fixed elements are main frame side plate 36 which acts as stationary support means for adjustably mounting cam 38 in proximity for actuating valve mechanism 48 carried on the die cutter roll 20.

The remainder of the elements shown rotate with die cutter roll 20 about axis 32. Valve-supporting details are omitted for clarity. The opposite end of the assembly may be the same, or it may only mount that end of the die cutter roll rotatably. Element 49 is a bearing for journal 42.

OPERATION

In operation, compressed air or other gas from any suitable source enters through a conventional rotary seal (not shown) between fixed parts (not shown) and the first roll means 20 with which the rotary seal is coaxial, and passes long axial bore 40 in journal 42 and then generally radially outwardly through input conduit 44 and manifold 46 to valve 48. On reciprocation of cam-following valve stem or valve actuator 50 as it rides radially outward on cam surface 52, valve 48 passes compressed air through a first chamber 54 formed with the valve housing 56 by recess-defining walls 58, 60 of the spool 62. The compressed air then passes through bore 64 and valve output conduit 66 along the periphery of the first roll means die board 67 to one or more scrap ejectors 28 located within each die cutting rule 22 at a level below which scrap S (phantom lines) wedges in the die cutting rule. Each scrap ejector 28 is a pneumatically powered assembly of housing or cylinder 68, and piston 70 with cup-shaped gasket 77 sealing it to the inner wall of the cylinder. When powered, this assembly extends an end of the piston radially as a plunger and pushes scrap radially out of the die cutting rule 22. The piston may have an integral foot 72 attached by a screw 73 threaded in the plunger portion of the piston and holding the foot 72 against the end of the plunger portion. The foot provides larger-area urging of scrap. The cylinder 68 may be secured to the die board 67 by any suitable means, press-fit being indicated. Press-fitting is facilitated by the "Z"-shaped angling inwardly along and into the cylinder, of the connector tube 75. Valve output conduit 66 may pass through a notch 22' in the die cutting rule which is conventionally affixed to the die board 67.

After ejection of scrap S by the mechanism, valve actuator 50 rides off cam surface 52 causing the valve 48 to vent compressed air in the ejector 28 to the atmosphere through line 66, as compression spring 76 in the valve housing 56 axially restores valve spool 62 to a radially inward position. In the radially inward position the full diameter spool portion 78 of valve 48 closes off the compressed-air supply from manifold 46 and connects passage 64 with exhaust port 80, freeing the scrap ejector piston 70 to be retracted by contact with the next-succeeding paperboard sheet at the begining of the next cycle of operation. The retraction is thus relatively low-force retraction. Retraction may be assisted by or entirely done by compression spring 81 between the inside of the outer end of cylinder 68, and the piston 70 enlarged lower end.

Figure 3:
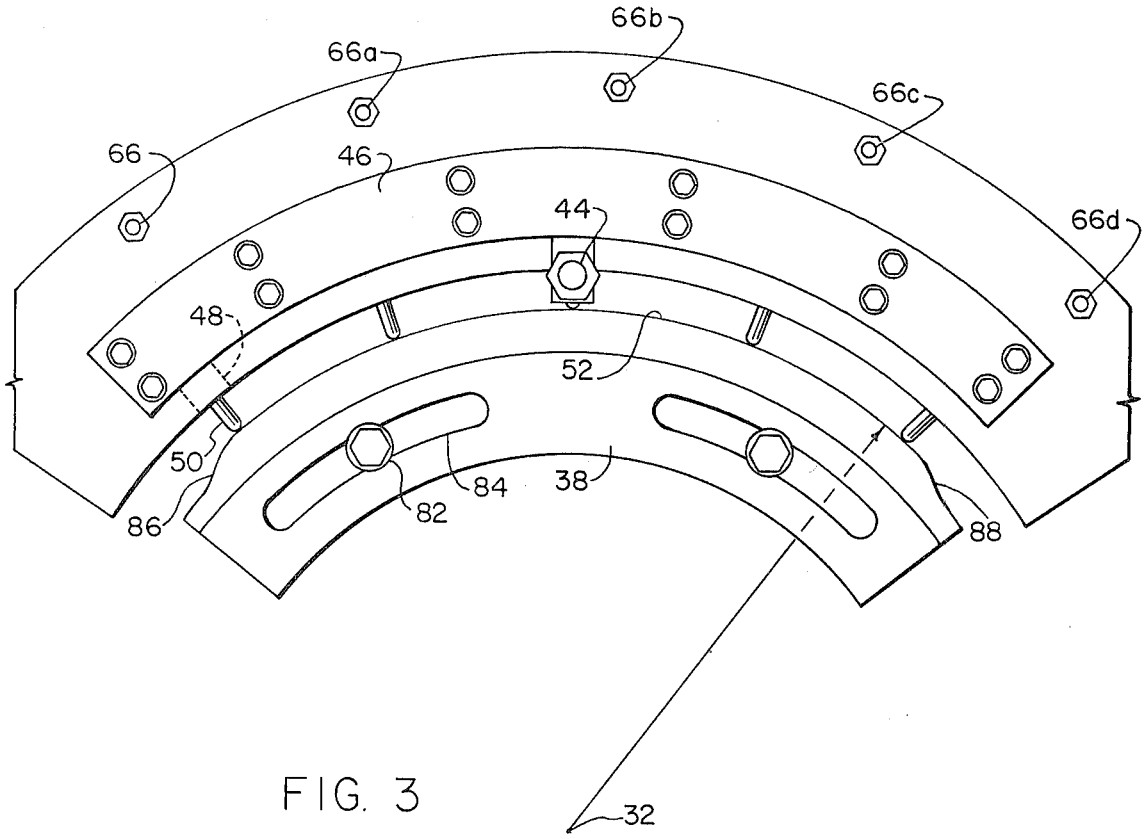
FIG. 3 is a fragmentary view taken at 3—3, FIG. 2.

FIG. 3 shows provision for adjusting actuation-phase or timing of the ejection system. The cam surface 52 is centered on the axis 32. It can be adjusted circumferentially by means of clamping screws 82 in one or more elongate slots 84 coaxial with the cam surface. A leading ramp 86 enables valve actuators to ride-out smoothly onto the cam surface and a trailing ramp 88 lets them ride-in smoothly when leaving the cam surface.

To suit differing shapes and sizes of die cutting rules, various stations for scrap ejectors may be provided, as at the plurality of air lines 66, 66*a*, 66*b*, 66*c*, 66*d*. Each station may have a valve with valve actuator 50. The valve actuators are preferably equally spaced on radii in a series and depending on number and proximity, may be spanned by the cam 38. The valves may be supplied by the compressed gas input conduit 44 through a valve-intake manifold 46 common to all valves, and preferably with arcuate shape, centered on the axis of the first roll means for efficient distribution and ease in balancing.

The axis-centered disposition of cam 38 and the radial relation of each valve 48 and valve actuator 50 in the successive circumferential areas coact to assure proper synchronization of scrap ejectors.

A short circumferential length of scrap may be ejected as a unit; lengths which extend across more than one of the stations may be freed at the leading edge first and then successively at points toward the trailing edge. Cam-span is sufficient to hold open the valve or valves required at a particular location for a time sufficient to ensure operation and ejection of scrap.

A suitable valve 48 is sold by Numatics, Inc. of Highland, Mich. 48031 as 12DAD valve No. 209-121B, a representative spool-and-sleeve valve. With the reciprocating actuator at a first position (maximum extension from the valve body) the valve will close off an intake line and vent an output line to the atmosphere. With the actuator in a second position farther into the valve body, the valve will connect in-take and output. The distal end of the valve actuator has an opening permitting ready bias to the first position by means of a compression spring in any suitable conventional housing.

This invention is not to be construed as limited to the particular forms disclosed herein, since these are to be regarded as illustrative rather than restrictive. It is, therefore, to be understood that the invention may be practiced within the scope of the claims otherwise than as specifically described. For example, the invention will also work with steel-to-steel die cutting as well as with the resilient anvil die cutting described. In steel-to-steel die cutting, the supporting anvil roll is steel and the die cutting rules have a straight, not serrated edge. The rule penetrates the blank and pinches against the steel roll.

What is claimed and desired to be protected by U.S. Letters Patent is:

1. In a rotary soft-anvil die cutting means, apparatus for removing scrap portions of a paperboard blank from die cutting rules used to cut such scrap portions in said blank comprising in combination:

first and second roll means between which said blank is advanced for cutting said scrap portions therein, said first roll means including said die cutting rules mounted thereon, said die cutting rules adapted to cut and remove said scrap portions from said blank and to retain the same within said die cutting rules;

an ejector means within said die cutting rules for pushing said scrap portions from said die cutting rules;

a pneumatic means connected to said ejector means for actuating said ejector means, timing means adapted to energize said pneumatic means after said blank has advanced between said first and second roll means for pushing scrap portions out of said die cutting rules, said pneumatic means including a valve means on an end of said first roll means for supplying pressurized air to said ejector means; said timing means including a cam means fixed adjacent said end of said first roll means for actuating said valve means at least once during each revolution of said roll means for directing said pressurized air from said valve means to said ejector means, and said cam means being movable to selected locations for actuating said valve means at a predetermined circumferential location following cutting of said scrap portions in said blank.

2. In a system for cutting paperboard blanks in succession, including first roll means with an axis, a die cutting rule on the circumference of the first roll means, at least one scrap ejector means at the die cutting rule, means for actuating said at least one scrap ejector means, and second roll means for supporting paperboard blanks against the die cutting rule for cutting said paperboard blanks, the improvement comprising in combination: said means for actuating comprising a pneumatic system, said pneumatic system including an input conduit leading outwardly from the axis of said first roll means, at least one valve at an end of the first roll means and having connection to the input conduit for receiving compressed gas therefrom, at least one output conduit, said at least one output conduit communicating with the valve and a said scrap ejector means for extending said scrap ejector means to eject scrap from the die cutting rule, means for retracting said scrap ejector means when extended, including said valve having means for exhausting compressed gas from the output conduit and said scrap ejector means proportioned for striking a said succeeding paper board blank and being forced thereby to a retracted position within said die cutting rule, in synchronism with said exhausting.

3. In a system for cutting paperboard blanks in succession, including first roll means with an axis, a die cutting rule on the circumference of the first roll means, at least one scrap ejector means at the die cutting rule, means for actuating said at least one scrap ejector means, and second roll means for supporting paperboard blanks against the die cutting rule for cutting said paperboard blanks, the improvement comprising in combination: said means for actuating comprising a pneumatic system, said pneumatic system including an input conduit leading outwardly from the axis of said first roll means, at least one valve at an end of the first roll means and having connection to the input conduit for receiving compressed gas therefrom, at least one output conduit, said at least one output conduit communicating with the valve and a said scrap ejector means for extending said scrap ejector means to eject scrap from the die cutting rule, a plurality of said valves, at least one scrap ejector means communicating with each respective valve through a said output conduit, and said valve connection to the input conduit including a manifold for supplying said compressed gas from the input conduit to all said valves.

4. In a system as recited in claim 3, each valve having a respective cam follower means for operating said valve; a cam, and stationary support means for adjustably mounting said cam in position for cyclical contact with each cam follower means for operating said valve.

5. In a system as recited in claim 4, said cam having arcuate shape centered on said axis, and each cam follower means extending along a respective radius of the first roll means.

6. In a system as recited in claim 5, said radii being in a substantially equally spaced series containable within a span of said cam, and said adjustable mounting of the cam including means defining at least one fastener slot coaxially therein.

7. In a system as recited in claim 6, said cam having a leading end and a trailing end circumferentially spaced apart, and a respective ramp for said cam followers on each of said leading and trailing ends.

8. In a system as recited in claim 3, the manifold having the shape of an arc centered on said axis of the first roll means.

9. In a system for cutting paperboard blanks in succession, including first roll means with an axis, a die cutting rule on the circumference of the first roll means, at least one scrap ejector means at the die cutting rule, means for actuating said at least one scrap ejector means, and second roll means for supporting paperboard blanks against the die cutting rule for cutting said paperboard blanks, the improvement comprising in combination: said means for actuating comprising a pneumatic system, said pneumatic system including an input conduit leading outwardly from the axis of said first roll means, at least one valve at an end of the first roll means and having connection to the input conduit for receiving compressed gas therefrom, at least one output conduit, said at least one output conduit communicating with the valve and a said scrap ejector means for extending said scrap ejector means to eject scrap from the die cutting rule, the input conduit extending in a radial direction from said axis to said valve connection to the input conduit, and the output conduit extending from said valve along the periphery of said first roll means to said ejector means.

10. In a system for cutting paperboard blanks in succession, including first roll means with an axis, a die cutting rule on the circumference of the first roll means, at least one scrap ejector means at the die cutting rule, means for actuating said at least one scrap ejector means, and second roll means for supporting paperboard blanks against the die cutting rule for cutting said paperboard blanks, the improvement comprising in combination: said means for actuating comprising a pneumatic system, said pneumatic system including an input conduit leading outwardly from the axis of said first roll means, at least one valve at an end of the first roll means and having connection to the input conduit for receiving compressed gas therefrom, at least one output conduit, said at least one output conduit communicating with the valve and a said scrap ejector means for extending said scrap ejector means to eject scrap from the die cutting rule, the die cutting rule having an aperture therein and the output conduit passing through said aperture and inwardly along said scrap ejector means for supplying pneumatic pressure thereto.

* * * * *